US009096976B2

(12) United States Patent
Berning et al.

(10) Patent No.: US 9,096,976 B2
(45) Date of Patent: Aug. 4, 2015

(54) SELF-PROPELLED BUILDING MACHINE AND METHOD FOR OPERATING A BUILDING MACHINE

(71) Applicant: Wirtgen GmbH, Windhagen (DE)

(72) Inventors: Christian Berning, Brühl (DE); Dirk Franzmann, Hennef (DE); Armin Montermann, Andernach (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 25 days.

(21) Appl. No.: 13/790,147

(22) Filed: Mar. 8, 2013

(65) Prior Publication Data

US 2014/0049093 A1 Feb. 20, 2014

(30) Foreign Application Priority Data

Aug. 16, 2012 (DE) ..... 10 2012 016 173

(51) Int. Cl.
*E01C 23/088* (2006.01)
*E01C 23/12* (2006.01)
(Continued)

(52) U.S. Cl.
CPC ..... *E01C 23/088* (2013.01); *E01C 23/127* (2013.01); *E21C 25/06* (2013.01); *E21C 47/00* (2013.01)

(58) Field of Classification Search
CPC .. E01C 23/088; E01C 23/127; B60G 2300/09
USPC ..... 299/1.5, 39.1, 39.2, 39.4, 39.6
See application file for complete search history.

(56) References Cited

U.S. PATENT DOCUMENTS 4,343,513 A 8/1982 Godbersen
4,929,121 A 5/1990 Lent et al.
(Continued)

FOREIGN PATENT DOCUMENTS

DE 4017107 A1 3/1991
DE 102010015173 A1 10/2011
(Continued)

OTHER PUBLICATIONS

European Search Report in corresponding European Patent Application EP 13003913, dated Nov. 18, 2013 (2 pp) (not prior art).
(Continued)

*Primary Examiner* — David Bagnell
*Assistant Examiner* — Michael Goodwin
(74) *Attorney, Agent, or Firm* — Lucian Wayne Beavers; Patterson Intellectual Property Law, PC

(57) ABSTRACT

A self-propelled building machine, especially a road cutting machine or a surface miner, has a machine frame and a chassis, comprising running gears resting on the ground. In addition, the present invention relates to a method for operating such a building machine. In an operating mode for adjusting the working depth of the working device the imposed weight applied by the building machine on the running gear is measured, whereby depending on the imposed weight either a controlled or an uncontrolled lowering of the building machine is indicated. A measuring device comprises a sensor for measuring the weight imposed by the building machine on at least one of the running gears. Depending on the measured imposed weight, a signal is generated indicating an uncontrolled lowering of the building machine, if the imposed weight falls short of a predetermined value and/or a signal indicating a controlled lowering of the building machine is generated if the imposed weight reaches or exceeds a predetermined threshold value.

22 Claims, 2 Drawing Sheets

(51) Int. Cl.
*E21C 25/06* (2006.01)
*E21C 47/00* (2006.01)

(56) References Cited

U.S. PATENT DOCUMENTS

| | | | | |
|---|---|---|---|---|
| 5,092,659 | A | 3/1992 | Grathoff | |
| 5,318,378 | A | 6/1994 | Lent | |
| 5,879,056 | A | 3/1999 | Breidenbach | |
| 6,152,648 | A * | 11/2000 | Gfroerer et al. | 404/84.05 |
| 6,170,341 | B1 | 1/2001 | Avitan | |
| 6,338,281 | B1 | 1/2002 | El-Ibiary et al. | |
| 7,422,391 | B2 | 9/2008 | Holl et al. | |
| 8,100,480 | B2 * | 1/2012 | Kotting et al. | 299/39.2 |
| 8,128,177 | B2 | 3/2012 | Menzenbach et al. | |
| 8,292,371 | B2 | 10/2012 | Menzenbach et al. | |
| 8,408,838 | B2 | 4/2013 | Willis et al. | |
| 2004/0120766 | A1 | 6/2004 | Silay | |
| 2008/0150347 | A1 | 6/2008 | Moller et al. | |
| 2008/0152428 | A1 * | 6/2008 | Berning et al. | 404/84.1 |
| 2008/0199117 | A1 | 8/2008 | Joki | |
| 2011/0193397 | A1 * | 8/2011 | Menzenbach et al. | 299/1.5 |
| 2013/0082507 | A1 | 4/2013 | Wachsmann | |

FOREIGN PATENT DOCUMENTS

| | | | |
|---|---|---|---|
| JP | 58189402 | A | 11/1983 |
| JP | 59080505 | A | 5/1984 |
| JP | 2190503 | A | 7/1990 |
| JP | 3199513 | A | 8/1991 |
| WO | 2008115560 | A1 | 9/2008 |

OTHER PUBLICATIONS

Exhibit A: Brochure re Model DA 120 available from ME-Messsysteme GmbH of Hennigsdorf, Germany. (admitted to be prior to Aug. 15, 2012).

* cited by examiner

SELF-PROPELLED BUILDING MACHINE AND METHOD FOR OPERATING A BUILDING MACHINE

BACKGROUND OF THE INVENTION

1. Field of the Invention

The present invention relates to a self-propelled building machine, in particular a road cutting machine or a surface miner, having a machine frame and a chassis that comprises running gear that rests on the ground below. Furthermore, the present invention relates to a method for operating such a building machine.

2. Description of the Prior Art

Self-propelled building machines of the above type comprise a working device that is arranged on the machine frame, which comprises a working roller that has to be brought into contact with the ground to work the ground below. This working roller can be in the form of a milling or a cutting roller, by means of which, for example, damaged layers of road can be removed, or mineral resources can be extracted from the ground.

In known road cutting machines and surface miners, the working roller is located in a roller housing which is open at the bottom, that is closed by a pressure element arranged in the direction of working in front of the working roller and by a stripper device arranged in the direction of working behind the roller. On at least one side, the roller housing is closed by a plate extending in the direction of working, which is designated as an edge protection.

The height of the machine frame of the known building machines can be adjusted in relation to the surface of the ground if the machine is positioned with the running gear resting on the ground. For this purpose, such building machines comprise a device for adjusting the height of the machine frame, which is activated by a control unit. As the working device is arranged on the machine frame, this adjustment affects not only the height of the machine frame, but also that of the working roller. In addition, the height of the working device can be adjusted in relation to the machine frame.

During the operation of the building machine, the height of the machine frame is set in such a way that the cutting roller of the working device penetrates the ground. At the same time, if necessary, the height of the pressure element and the stripper device and also of the edge protection can be adjusted in relation to the machine frame. In general, the pressure element, the stripper device and the edge protection are mounted in a floating manner, so that the height can be adjusted independently. This has the effect that the pressure element, the stripper device and the edge protection can follow the surface of the ground and the roller housing is always closed at the bottom.

When adjusting the working depth of the working device, the problem arises that, when the machine frame is lowered, the working roller does not penetrate the ground quickly enough. The speed at which the working roller penetrates the ground is determined by the condition of the working roller, the condition of the ground and the weight of the building machine. If the working roller does not penetrate the ground quickly enough and the machine frame is lowered further, there is a risk that the working roller will sink too deep into the ground. This problem is known in practice as a "sighting hole".

It can also happen during the operation of the building machine that the edge protection, the stripper device or the pressure element, which are height-adjustably suspended or mounted on the machine frame, can become jammed while being adjusted. If the machine frame is lowered with the edge protection, the stripper device or the pressure element in a jammed state, it can happen that the building machine jerks backwards onto the running gears or the working roller if the jamming is suddenly released. This can damage the working roller or the drive train, for example.

SUMMARY OF THE INVENTION

It is therefore the aim of the present invention to propose a self-propelled building machine in which an uncontrolled lowering of the machine is prevented when the working depth of the working device is adjusted. A further aim of the present invention is to propose a method for operating a building machine whereby an uncontrolled lowering of the machine is avoided.

According to the present invention, this aim is achieved by the features contained in the independent claims of the patent. The objects of the dependent claims relate to preferred embodiments of the invention.

The building machine according to the present invention provides for an operating mode to adjust the working depth of the working device, in which the machine frame is lowered. This operating mode is characterised by the fact that although the working device is driven, the machine is at a standstill. In this respect, this operating mode differs from the operating mode in which the working device is driven so that the ground can be worked during the forward movement of the machine.

The basic principle of the present invention lies in the fact that, in order to prevent any uncontrolled sinking of the building machine in the above operating mode, the imposed weight exercised by the building machine on the running gears has to be measured, whereby it is assumed that the uncontrolled sinking of the building machine occurs if the running gears are not resting on the ground when the cutting roller is lowered.

The machine frame of the building machine is lowered as a result of the relative movement of the running gears and the machine frame. If the machine frame is to be lowered at a faster rate than that at which the working roller penetrates the ground, the running gears are lifted off the ground, so that the imposed weight is less than a predetermined threshold weight measured against the imposed weight of the building machine and the running gears on the ground. In practice, the imposed weight falls to zero at the moment at which the running gears are lifted off the ground and all control over the lowering process is immediately lost.

In the building machine according to the present invention and the method according to the present invention, the lifting of the running gears is identified by measuring the imposed weight, whereby depending on the imposed weight, the lowering action will be either controlled or uncontrolled. If the lowering action is uncontrolled, appropriate steps must be taken.

In principle, the imposed weight can only be measured on one of the running gears, on a part of the running gears or on all height-adjustable running gears. Preferably, the imposed weight is measured on all height-adjustable running gears, whereby preferably an uncontrolled lowering can be determined in relation to the imposed weight if at least one of the running gears is lifted off the ground.

For the purpose of the present invention, the term "running gear" is understood to signify any means by which the building machine rests as intended on the ground. The running gears can be, for example, wheels or crawler tracks.

The building machine according to the present invention is characterised by a measuring device, which comprises a means for measuring the imposed weight applied by the building machine on at least one of the running gears or alternatively a physical value correlating to the imposed weight. In practice, the calculation of a value correlating to the imposed weight enables a simple calculation to be made of the measurement using methods known to the state of the art.

Furthermore, the building machine according to the present invention comprises an evaluation device, which, according to the measured imposed weight or the physical value correlating to the imposed weight, generates a signal in the operating mode of the lowering of the building machine, referred to below as a control signal, that signals an unwanted and uncontrolled lowering of the building machine, if the imposed weight reaches or falls below a predetermined threshold value, and/or generates a signal that signals a controlled lowering of the building machine if the imposed weight exceeds a predetermined threshold value.

In this connection, the term "control signal" is understood to represent any value, by which the information of a controlled lowering or an uncontrolled lowering is indicated. In a preferred embodiment, electrical signals are used for the transmission of information, whereby an electrical signal is understood to be either a digital or an analogue signal.

In a preferred embodiment of the present invention, the control unit for adjusting the height of the machine frame functions together with the evaluation unit in such a way that in the operating mode of the lowering of the building machine any further lowering of the building machine is prevented if the control unit receives a control signal from the evaluation unit indicating that an uncontrolled lowering of the building machine has been signaled. Alternatively, it is also possible not to carry out any height adjustments until the control unit has received a control signal from the control unit indicating a controlled lowering of the building machine.

A further preferred embodiment provides for a signaling unit having an acoustic and/or a visual signal and/or a tactile signal emitter, with the signaling unit emitting an acoustic and/or a visual and/or a tactile signal if the signaling unit receives a signal from the evaluation unit indicating an uncontrolled lowering of the building machine. Alternatively a controlled lowering can be signaled.

The automatic interruption or release of the height adjustment and the signaling of an uncontrolled or a controlled lowering can also be combined, so that the machine operator is notified of an action taking place in the machine control system.

For the purpose of the invention it is not important which parts of the building machine are brought into contact with the ground when the height of the machine frame is being adjusted. In practice, there is above all the danger that the building machine with the working roller is placed on the ground before the working roller has been able to penetrate the ground.

However, if the working roller is arranged in a roller housing that is open at the bottom, and is closed on at least one side by a height-adjustable edge protection and/or is closed on the front side in the direction of working by a height-adjustable pressure element and/or is closed on the rear side by a height-adjustable stripper device, both the method according to the present invention and the device according to the present invention will prevent the building machine from falling onto the running gears or the working roller if these parts of the working device should become jammed and are then released as the machine frame is lowered.

BRIEF DESCRIPTION OF THE DRAWINGS

Below, different embodiments of the present invention are described with reference to the figures.

These show.

DETAILED DESCRIPTION

Figure 1:
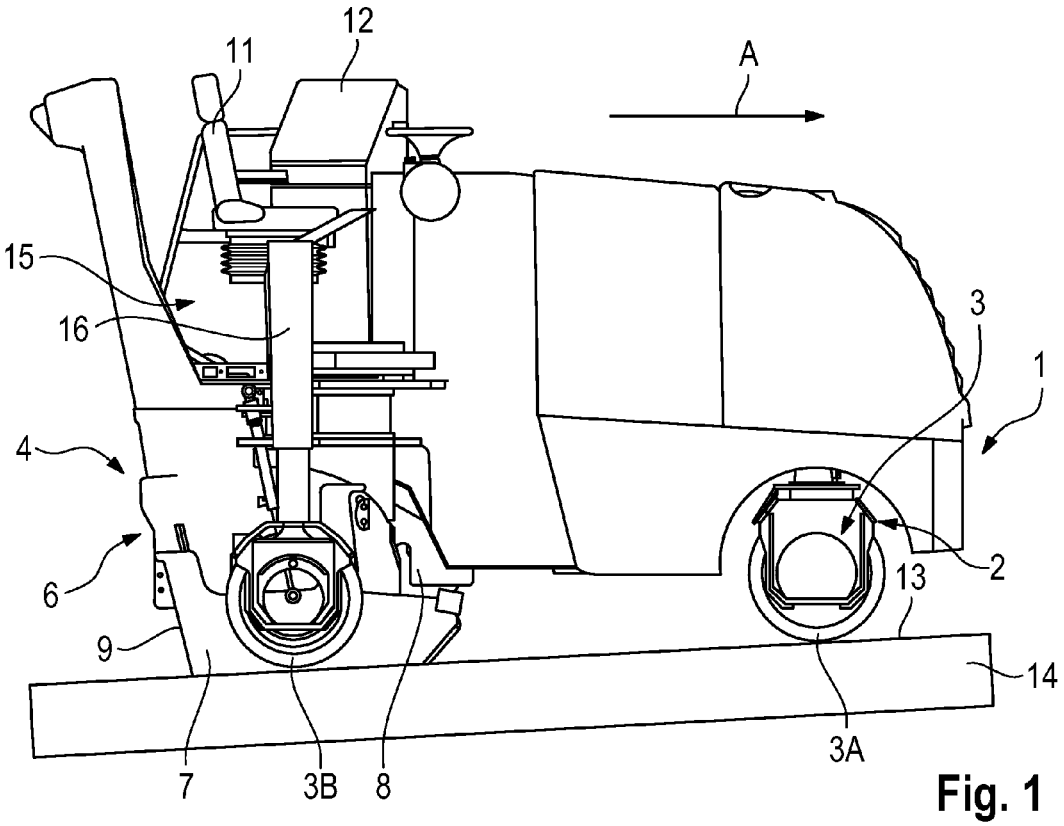
FIG. 1 a side aspect of a road cutting machine.

FIG. 1 shows the side aspect of a road cutting machine, which represents a small cutting machine. The road cutting machine comprises a machine frame 1, which is supported by a chassis 2. The chassis comprises running gears 3, which include one front wheel 3A and two rear wheels 3B. In FIG. 1, only the rear right-hand wheel 3B is visible. In known building machines, the chassis can comprise, for example, crawler tracks instead of wheels.

The cutting machine comprises a working device 4, which is arranged on the machine frame 1. The working device 4 comprises a working roller, which is in the form of a cutting roller. The cutting roller, which is not visible in FIG. 1, is arranged in a cutting roller housing 6 of the working device. The cutting roller housing 6 on the left and right side of the direction side of working A is enclosed by an edge protection 7. In FIG. 1 only the edge protection 7 in the direction of working is visible. At the front side in the direction of working A, the cutting roller housing 6 is enclosed by a pressure element 8 and at the rear side in the direction of working A by a wiper device 9. Above the cutting roller housing 6, there is the control stand for the cutting machine with the operator's seat 11 and the control panel 12.

The height of the machine frame 1 of the cutting machine is adjustable in relation to the surface 13 of the ground 14. The device 15 to adjust the height of the machine frame comprises in the direction of working A a left-hand rear lifting column and a right-hand rear lifting column, which support the machine frame. The left-hand lifting column is attached to the left-hand running gear 3 and the right-hand lifting column is attached to the right-hand running gear 3. FIG. 1 shows only the right-hand lifting column 16. When the running gears 3 are resting on the ground 14, the machine frame 1 is raised by the outward and return movements of the lifting columns 16, which are controlled by a control unit 17. As the working device 4 is attached to the machine frame 1, the height of the cutting roller above the surface of the ground can be adjusted by adjusting the height of the machine frame. By adjusting the height of the machine frame, the height of the edge protection 7, the pressure element 8 and the wiper device 9, which are also arranged on the machine frame are also adjusted. However, the height of the edge protection, the pressure element and the wiper device is also adjustable in relation to the machine frame. The devices to adjust the height of the edge protection, the pressure element and the wiper device, which are not shown in FIG. 1, ensure a floating position to the edge protection, the pressure element and the wiper device, in which the edge protection, the pressure element and the wiper device rest on the ground in a floating manner.

The control device 17 comprises an operating mode, in which the machine frame 1 of the cutting machine is lowered to adjust the cutting depth. This process is also known as "sighting". The machine operator can engage this operating mode, for example, by activating a control on the control panel 12, for example a press-button or a switch.

Figure 2:
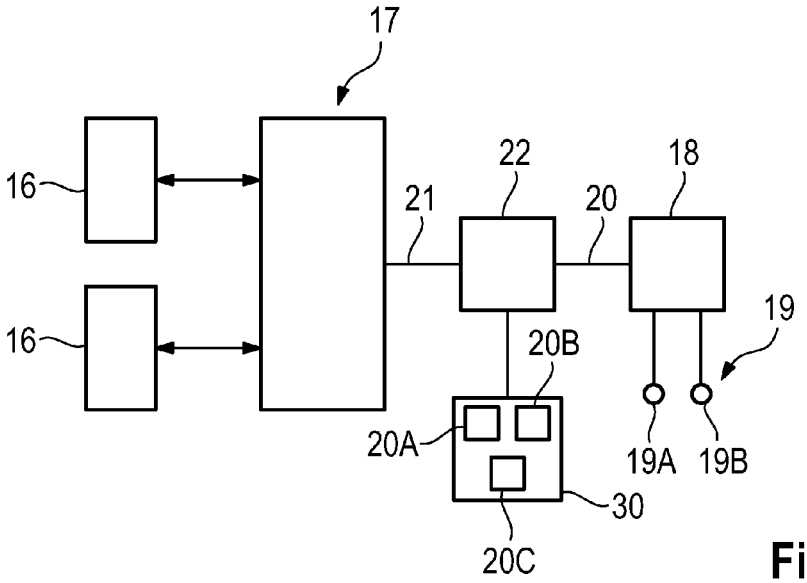
FIG. 2 a block diagram of the control unit, the measuring device, the evaluation unit and the signaling unit of the road cutting machine, FIG. 3 a greatly simplified schematic representation of a lifting column and a running gear of the road cutting machine, whereby the running gear rests on the ground and FIG. 4 a greatly simplified schematic representation of a lifting column and a running gear of a road cutting machine, with the running gear lifted off the ground.

In addition to the control unit 17 to control the device 4 to adjust the height of the machine frame with the left-hand and the right-hand lifting column 16, the cutting machine also comprises a measuring device 18, an evaluation unit 22 and a signaling unit 30, which are shown in FIG. 2 together with the lifting columns 16 in a block diagram. All units can form separate building elements or can be a part of the central control system of the building machine.

The lifting columns 16 are hydraulically operated. The hydraulic system is not shown in FIG. 2. By means of the control unit 17, the hydraulic lifting columns 16 can be operated in such a way that the lifting columns are moved inwards and outwards allowing the machine frame 1 to be raised or lowered when the running gears 3 are resting on the ground.

The measuring device 18 comprises means 19 to measure the imposed weight of the cutting machine on the running gears. The means for measuring the imposed load include a first measurement indicator 19A for measuring the imposed weight on the rear left-hand running gear and a second measurement indicator 19B for measuring the imposed weight on the rear right-hand running gear. These are described individually in detail below with reference to the FIGS. 3 and 4.

The measuring device 18 is connected to the evaluation unit 22 via a data connection 20, which is in turn connected via a data connection 21 to the control unit. The measurement indicators 19A, 19B generate signals on the basis of the imposed load. In simple terms, the measurement indicators generate a signal if the running gear is resting on the ground and it generates no signal if the running gear is not resting on the ground or vice versa. However, the measurement indicators can also generate a signal that is proportional to the size of the imposed weight, for example an alternating voltage, with the amplitude increasing in direct proportion to the imposed weight. The evaluation unit 22 compares the output signal from the first and the second measurement indicators 19A, 19B respectively with a threshold value, which, in the simplest case is zero. If the output signal from the first indicator is equal to zero and/or the output signal from the second measurement indicator is equal to zero, the evaluation unit 22 generates a control signal indicating an uncontrolled lowering of the building machine indicating that at least one of the two rear running gears is not resting on the ground. On the other hand, the evaluation unit 22 does not generate the control signal if the output signal from the first and second measurement indicators is greater than zero, i.e. both running gears are resting on the ground. In this case, the evaluation unit 22 can also generate a second control signal that indicates a controlled lowering of the building machine. However, a signal evaluation of this type is to be understood as being only one of a number of possible embodiments, as the generation of corresponding signals and their evaluation belongs as such to the state of the art.

The signaling unit 30 comprises an acoustic and/or a visual and/or a tactile signal emitter 20A, 20B, 20C. If the signaling unit 30 receives a control signal from the evaluation unit 22 indicating an uncontrolled lowering of the building machine during the operating mode selected by the machine operator for adjusting the cutting depth, the signaling unit sends the machine operator an acoustic and/or a visual and/or a tactile signal, so that he can take the necessary steps to restore the machine to a controlled state.

By way of example, it is assumed that, in the operating mode for adjusting the cutting depth, the machine operator lowers the machine frame more quickly that the cutting roller can penetrate the ground. Consequently, at least one of the two running gears loses contact with the ground, so that the evaluation unit 22 generates a signal indicating an uncontrolled lowering of the building machine. This is immediately communicated to the machine operator by means of the signaling unit 30. The machine operator can then restore a controlled lowering by interrupting the lowering of the machine frame immediately, although he can also raise the machine frame again if this should be necessary.

A further embodiment of the present invention provides for the fact that not only the evaluation unit 22 but also the control unit 17 for adjusting the height of the machine frame 1 receives a control signal indicating an uncontrolled sinking. The control unit is configured in such a way that, after a control signal is received, it can prevent or interrupt any adjustment to the height by the lifting columns 16. Additionally, the signaling unit 30 can communicate the automatic correction to the machine operator. Moreover, after receiving the control signal, the control unit 17 can intervene further in the control of the machine in order to return the machine to a controlled state, for example, it can lower a running gear 3 that has already been slightly raised until the evaluation unit receives a signal indicating a controlled lowering. These corrections can be made by the control unit on the basis of a predetermined program. This ensures that an uncontrolled lowering can be corrected immediately if the correction is not carried out manually by the machine operator.

Figure 3:
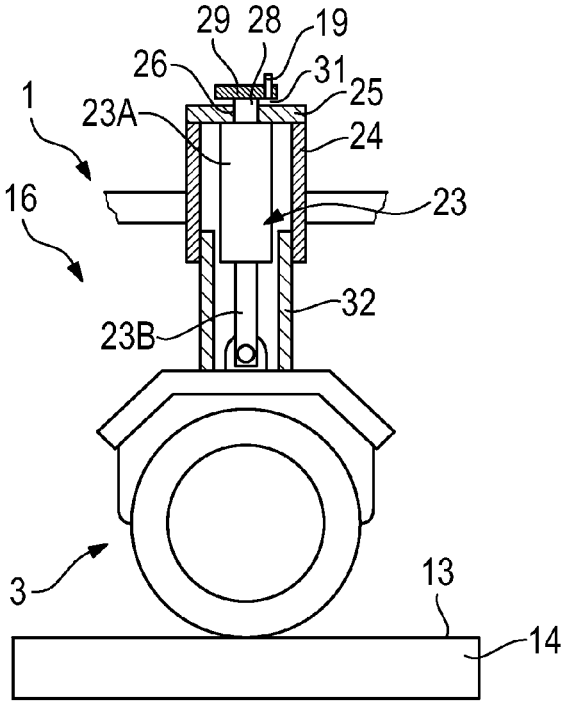
Figure 4:
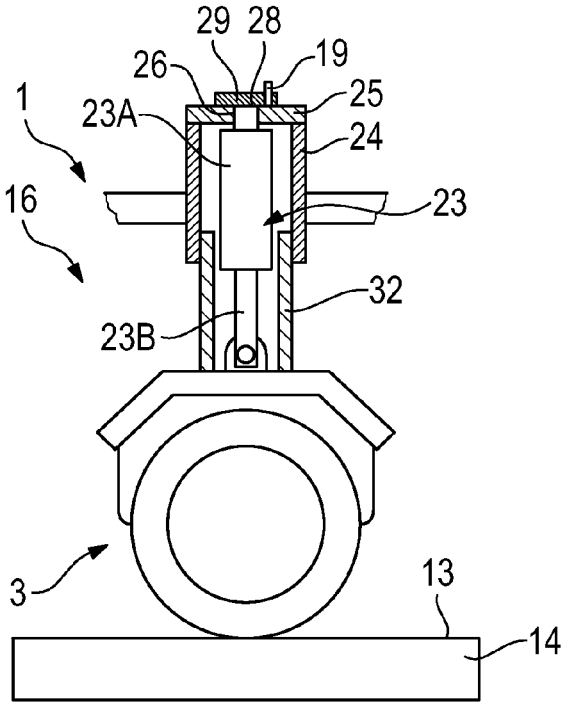

FIGS. 3 and 4 show in a simplified schematic representation one of the two rear lifting columns 16 and the respective running gear 3, in which one wheel is supposed to be resting on the ground. The lifting column 16 comprises a piston/cylinder arrangement 23, which is arranged in an upper and a lower conductor pipe 24, 32, that concentrically encloses the piston/cylinder arrangement 23. The upper conductor pipe 24 is connected to the area of the lower part of the machine frame 1, which is only notionally indicated. On the upper side, the upper conductor pipe 24 is closed by means of a cover 25, which comprises a bore-hole 26. The piston 23B of the piston/cylinder arrangement 23 has, at its upper side, a guiding piece 28, that can be longitudinally displaced along the bore-hole 26 of the cover 25. A plate 29 is connected to the upper side of the guiding piece 28, the diameter of which is greater than that of the bore-hole in the cover. Consequently, the cylinder 23A can move in both an upwards and a downwards direction in the conductor pipes 24, 32 within the predetermined area, whereby the size of the gap 31 between the lower side of the plate 29 and the upper side of the lid 25 increases or reduces. When the running gear 3 rests on the ground 14, the cylinder 23A is supported with its upper side against the lower side of the cover 25. FIG. 3 shows the lifting column 16, when the running gear 3 rests on the ground 14, while FIG. 4 shows the lifting column once the running gear has lost contact with the ground.

In the present embodiment, the measurement indicator 19 is, for example, an inductive or a capacitive proximity switch that measures the distance between the lower side of the plate 29 and the upper side of the cover 25. However, instead of the proximity switch an electrical switching contact can be used, which is closed or opened when an imposed weight is applied by the building machine onto the running mechanism. Together with a distance gauge, the play-free mounting of the piston/cylinder arrangement 23 allows a simple and a reliable means of detecting any uncontrolled lowering of the machine.

What is claimed is:

1. A self-propelled building machine, comprising:

a machine frame;

a plurality of running gears configured to rest on a ground surface;

a working roller arranged on the machine frame and configured to contact the ground surface;

a height adjustable support configured to support the machine frame in a height adjustable manner relative to at least one of the running gears;

a sensor configured to detect a weight imposed by the building machine on at least one of the running gears; and a control system configured to control the height adjustable support, the control system having an operating mode in which the height adjustable support is adjustable to lower the machine frame to adjust a working depth of the working roller while the building machine is at a standstill, the control system including an evaluation unit configured such that a signal is generated in response to the imposed weight detected by the sensor, the signal indicating whether the imposed weight exceeds a predetermined threshold value.

2. The self-propelled building machine of claim 1, wherein:

the control system is configured such that when the signal indicates an uncontrolled lowering of the building machine wherein the imposed weight falls short of the predetermined threshold value, the controller control system activates the height adjustable support to prevent any further lowering of the machine frame.

3. The self-propelled building machine of claim 1, wherein:

the control system is configured such that when the signal indicates an uncontrolled lowering of the building machine wherein the imposed weight falls short of the predetermined threshold value, the control system activates the height adjustable support to raise the machine frame until the signal indicates that lowering is controlled.

4. The self-propelled building machine of claim 1, further comprising:

a signaling unit configured to generate an acoustic, visual or tactile warning in response to the signal from the evaluation unit when the signal indicates an uncontrolled lowering of the building machine wherein the imposed weight falls short of the predetermined threshold value.

5. The self-propelled building machine of claim 1, further comprising:

a roller housing in which the working roller is arranged, the roller housing having an open bottom and having at least one of a height-adjustable edge protection on at least one side, a height-adjustable pressure element on a front side, and a height-adjustable wiper on a rear side.

6. The self-propelled building machine of claim 1, wherein:

the height-adjustable support comprises at least one hydraulic lifting column attached to one of the running gears and supporting the machine frame.

7. The self-propelled building machine of claim 6, wherein:

the lifting column comprises a fixed component and a piston and cylinder arrangement configured such that the piston and cylinder arrangement is in a first position in which the piston and cylinder arrangement is supported against the fixed component if the running gear attached to the lifting column is subjected to an imposed weight, and the piston and cylinder arrangement is in a second position in which the piston and cylinder arrangement is not supported against the fixed component if the running gear attached to the lifting column is not subjected to an imposed weight.

8. The self-propelled building machine of claim 1, wherein:

the control system includes a control unit separate from the evaluation unit.

9. The self-propelled building machine of claim 1, wherein:

the control system includes a control unit and the control unit and the evaluation unit are both parts of the control system.

10. The self-propelled building machine of claim 1, wherein:

the evaluation unit is activated by the control system in the operating mode.

11. The self-propelled building machine of claim 1, wherein:

the evaluation unit is configured such that the signal indicates an uncontrolled lowering of the building machine when the imposed weight falls short of the predetermined threshold value, and the signal indicates a controlled lowering of the building machine when the imposed weight exceeds the predetermined threshold value.

12. The self-propelled building machine of claim 1, further comprising:

a control device engageable by an operator of the machine to activate the operating mode.

13. The self-propelled building machine of claim 1, wherein:

the control system is configured such that the height adjustable support is adjustable to lower the machine frame to adjust the working depth of the working roller while the building machine is at a standstill and the working roller is rotating.

14. A method of operating a self-propelled building machine, the machine having a machine frame and running gears, the machine having at least one working device arranged on the machine frame to be brought into contact with the ground, the method comprising:

(a) lowering the machine frame and thereby adjusting a working depth of the working device in the ground while the building machine is at a standstill; and (b) during step (a), detecting a weight imposed by the building machine on at least one of the running gears, and determining whether the imposed weight falls below a predetermined threshold value thus indicating an uncontrolled operating state.

15. The method of claim 14, further comprising:

preventing any further lowering of the machine frame if an uncontrolled operating state is indicated in step (b).

16. The method of claim 15, further comprising:

raising the machine frame until the imposed weight reaches or exceeds the predetermined threshold value thus indicating a controlled operating state.

17. The method of claim 14, further comprising:

generating a warning signal if an uncontrolled operating state is indicated.

18. The method of claim 17, wherein the warning signal is an acoustic signal or a visual signal or a haptic signal.

19. The method of claim 14, the machine including at least one hydraulic column connected between the machine frame and one of the running gears to adjust a height of the machine frame, the hydraulic column including a piston and cylinder arrangement, the method further comprising:

moving the piston and cylinder arrangement between a first position in which the piston and cylinder arrangement is supported against a fixed component of the hydraulic column when the running gear is subjected to an imposed weight, and a second position in which the piston and cylinder arrangement is not supported against the fixed component when the running gear is not subjected to an imposed weight; and detecting a distance between the fixed component and the piston and cylinder arrangement as a value for correlating to imposed weight.

20. The method of claim 14, wherein step (a) is performed under manual control by a machine operator.

21. The method of claim 14, wherein step (a) is performed under automatic control by a control system of the machine.

22. The method of claim 14, wherein during step (a) the working device is driven.

* * * * *

UNITED STATES PATENT AND TRADEMARK OFFICE

CERTIFICATE OF CORRECTION

PATENT NO. : 9,096,976 B2
APPLICATION NO. : 13/790147
DATED : August 4, 2015
INVENTOR(S) : Christian Berning It is certified that error appears in the above-identified patent and that said Letters Patent is hereby corrected as shown below:

Claims

In column 7, claim 2, line 25, delete “controller” before --control--.

Signed and Sealed this
Twenty-ninth Day of March, 2016

Michelle K. Lee

Michelle K. Lee
*Director of the United States Patent and Trademark Office*